US006447432B1

(12) United States Patent
Krull

(10) Patent No.: US 6,447,432 B1
(45) Date of Patent: Sep. 10, 2002

(54) APPARATUS AND METHODS FOR ADJUSTING RESISTANCE TO EXERCISE

(76) Inventor: Mark A. Krull, P.O. Box 57, Greencastle, IN (US) 46135

( * ) Notice: Subject to any disclaimer, the term of this patent is extended or adjusted under 35 U.S.C. 154(b) by 0 days.

(21) Appl. No.: 09/695,682

(22) Filed: Oct. 24, 2000

Related U.S. Application Data

(63) Continuation-in-part of application No. 09/387,160, filed on Aug. 31, 1999, now Pat. No. 6,183,401, which is a continuation-in-part of application No. 09/192,857, filed on Nov. 16, 1998, now Pat. No. 5,944,642, which is a continuation-in-part of application No. 09/149,181, filed on Sep. 8, 1998, now Pat. No. 5,935,048.

(60) Provisional application No. 60/162,291, filed on Oct. 28, 1999.

(51) Int. Cl.[7] ..... A63B 21/062

(52) U.S. Cl. ..... 482/98; 482/99

(58) Field of Search ..... 482/93, 94, 97–103, 482/133, 136–138, 148, 908

(56) References Cited

U.S. PATENT DOCUMENTS 5,776,040 A * 7/1998 Webb et al. ..... 482/98
5,989,165 A * 11/1999 Giannelli et al. ..... 482/100

OTHER PUBLICATIONS

Universal® Physical Conditioning Equipment 1981–82 catalog, pp. 20 and 34.*

* cited by examiner

*Primary Examiner*—John Mulcahy

(57) ABSTRACT

A weight stack exercise machine includes a stack of primary weights movably mounted on a frame, and secondary weight which are selectively movable between respective inactive positions, supported by the frame, and respective active positions, acting on the top plate in the primary weight stack. The frame supports the secondary weights in respective inactive positions, one above the other with a gap disposed therebetween.

20 Claims, 15 Drawing Sheets

Fig. 12
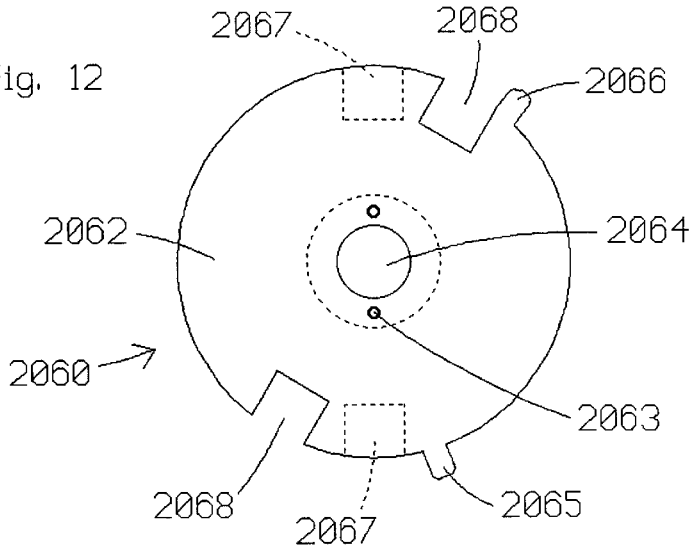
Fig. 14
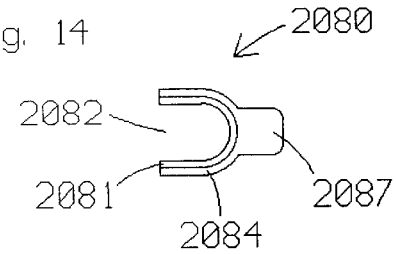
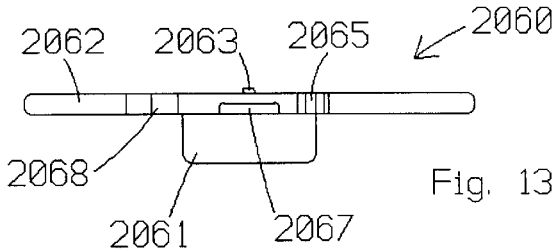
Fig. 13
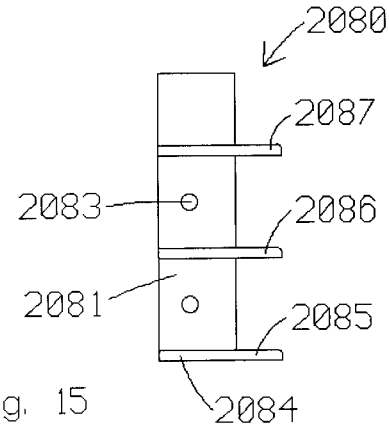
Fig. 15
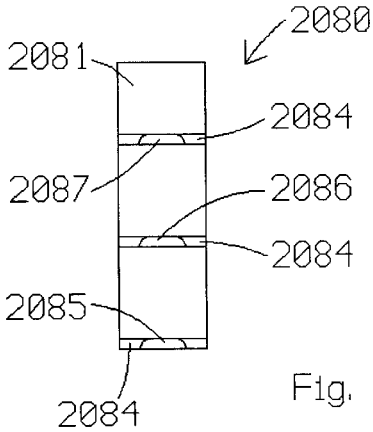
Fig. 16

APPARATUS AND METHODS FOR ADJUSTING RESISTANCE TO EXERCISE

CROSS-REFERENCE TO RELATED APPLICATIONS

This application is a continuation-in-part of U.S patent application Ser. No. 09/387,160, filed on Aug. 31, 1999 U.S. Pat. No. 6,183,401 which in turn, is a continuation-in-part of U.S. patent application Ser. No. 09/192,857, filed on Nov. 16, 1998 (U.S. Pat. No. 5,944,642), which in turn, is a continuation-in-part of U.S. patent application Ser. No. 09/149,181, filed on Sep. 8, 1998 (U.S. Pat. No. 5,935,048); and this application also discloses subject matter entitled to the filing date of U.S. Provisional Application No. 60/162, 291, filed on Oct. 28, 1999.

FIELD OF THE INVENTION

The present invention relates to exercise equipment and more particularly, to exercise equipment that uses a variable number of weights to resist exercise motion.

BACKGROUND OF THE INVENTION

Exercise weight stacks are known in the art. Generally speaking, weight plates are arranged in a stack and movably mounted on at least one guide rod or rail. A selector rod is connected to a desired number of weight plates by a pin (or other suitable means known in the art). The selector rod and any selected weight plates are connected to a force receiving member by a cable (or other suitable means known in the art) which pulls the weight plates upward in response to exercise movement.

Although exercise weight stacks are prevalent in the exercise industry, they nonetheless suffer from certain shortcomings. For example, in order to provide a large amount of weight at a reasonable cost and within a reasonable amount of space, equipment manufacturers typically use a small number of relatively heavy weight plates. As a result, the amount of weight being lifted cannot be adjusted in small increments. On the other hand, a relatively large number of lighter weight plates may be used to provide smaller increments in weight adjustment, but the resulting equipment would be relatively more expensive and/or bulky.

Attempts have been made to address the issue of incremental weight adjustments. One such approach involves the provision of a loose half-weight (weighing one-half as much as a weight plate in the stack) that is selectively movable onto the top plate at the discretion of a user. This particular arrangement is not well suited for institutional environments because the half-weight may be lost or misused. Another prior art approach involves the provision of a half-weight or other fractional weight(s) that is/are selectively movable from a peg on the frame onto an aligned peg on the top plate of the stack. This approach not only fails to overcome the possibility of losing the half-weight, but it creates a balance problem during movement of the selected weights, and it also increases the potential for injury due to the proximity of the two pegs and their movement relative to one another. Yet another prior art approach involves the provision of a second, smaller weight stack comprising weight plates which weigh a fraction of the weight plates in the primary stack. Unfortunately, this approach adds significantly to both the cost and the size of the equipment.

Yet another prior art weight stack machine with supplemental or secondary weights is disclosed in French Patent No. 2,613,237 to Louvet. The Louvet machine includes a stack of primary weight plates movable along a guide rod in response to exercise movement, and a stack of secondary weights movable along the guide rod and selectively stored above the stack of primary weight plates. The secondary weights are supported by gates which are rotatably mounted on rigid frame members, and which have pegs that rotate into engagement with holes in the frame members. Each of the nine secondary weights has a mass equal to one-tenth the mass of one of the primary weight plates. One disadvantage of the Louvet machine is that nothing prevents a user from releasing a secondary weight without grasping the weight. As a result, the secondary weight may be free to drop downward onto the top plate in the primary weight stack, thereby increasing the likelihood of personal injury and/or damage to the machine. Also, each of the secondary weights is not separately supported by a respective gate. As a result, the entire stack of secondary weights may be released at one time, with or without a user holding onto any of the weights.

Still other prior art approaches are disclosed in Soviet Union Patent No. 1347-948-A and Japan Patent No. 10-118222. Each of these patents discloses first and second secondary weights which are movably mounted on discrete guide rods outside the planform of the primary weight stack. The secondary weights in the Soviet patent are pivotally mounted on respective, dedicated guide rods for movement into positions overlying the top plate in the primary weight stack. The secondary weights in the Japan patent are releasably secured to the top plate by a separate selector pin. A shortcoming common to both of these approaches is the need for separate guide rods for the secondary weights, and/or the imposition of non-aligned weight on the primary weight stack. In other words, despite all of the efforts discussed above, room for better solutions and/or improvements remains.

SUMMARY OF THE INVENTION

Generally speaking, the present invention relates to exercise methods and apparatus involving a stack of primary weight plates movably mounted relative to a frame, and multiple secondary weights selectively activated to provide relatively smaller increments of weight adjustment. The secondary weights include a first weight and a second weight which are supported by the machine frame in respective, vertically aligned and spaced apart positions, and which are selectively movable to respective active positions, acting on the top plate. Among other things, the first weight may be maneuvered between its inactive position and its active position without disturbing the second weight. On the other hand, the first weight and the second weight are also preferably configured to register with one another, so that they can be maneuvered together, if so desired.

The secondary weights may be configured to engage and disengage the frame in various ways, including rotation, translation, or a combination thereof. Also, the secondary weights may be configured with a central opening to accommodate passage of a cable interconnected between a force receiving member and the top plate in the primary weight stack. Moreover, the present invention may be implemented on new equipment and/or tailored for retrofit on existing equipment, and/or the present invention may be implemented so that the secondary weights act upon the top plate throughout an exercise motion or any desired portion thereof. Many of the features, variations, and advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

FIG. 12 is a top view of a secondary weight on the exercise apparatus of FIG. 11;

FIG. 13 is a side view of the secondary weight of FIG. 12;

FIG. 14 is a top view of a secondary weight holder on the exercise apparatus of FIG. 11;

FIG. 15 is a front view of the secondary weight holder of FIG. 14;

FIG. 16 is a side view of the secondary weight holder of FIG. 14;

DETAILED DESCRIPTION OF A PREFERRED EMBODIMENT

The present invention provides methods and apparatus related to incremental adjustment of weight stack resistance. More specifically, an otherwise conventional weight stack machine is provided with fractional or secondary weights which preferably weigh a fraction of the weight plates in the primary weight stack and are selectively movable into an active position, acting upon the top plate in the primary weight stack.

Figure 1:
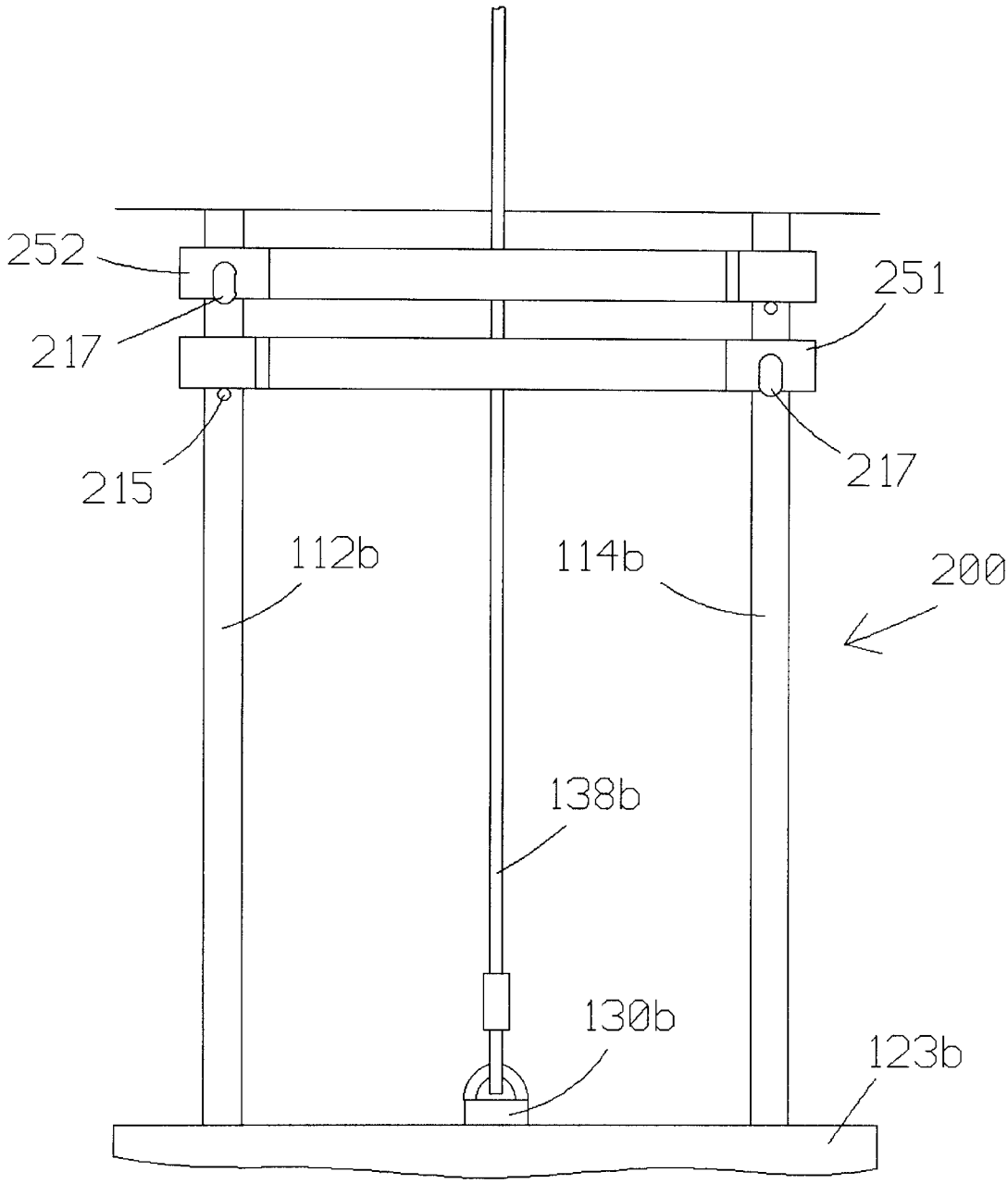
FIG. 1 is a partially fragmented, front view of an exercise apparatus constructed according to the principles of the present invention.

FIG. 1 shows a second weight stack exercise machine 200 which has been assembled in accordance with the principles of the present invention. The machine 200 includes a weight stack, including top plate 123*b* and underlying weight plates, movably mounted on guide rods 112*b* and 114*b*. A selector rod 130*b* extends through the weight stack and is connected to a force receiving member by means of cable 138*b*.

Figure 2:
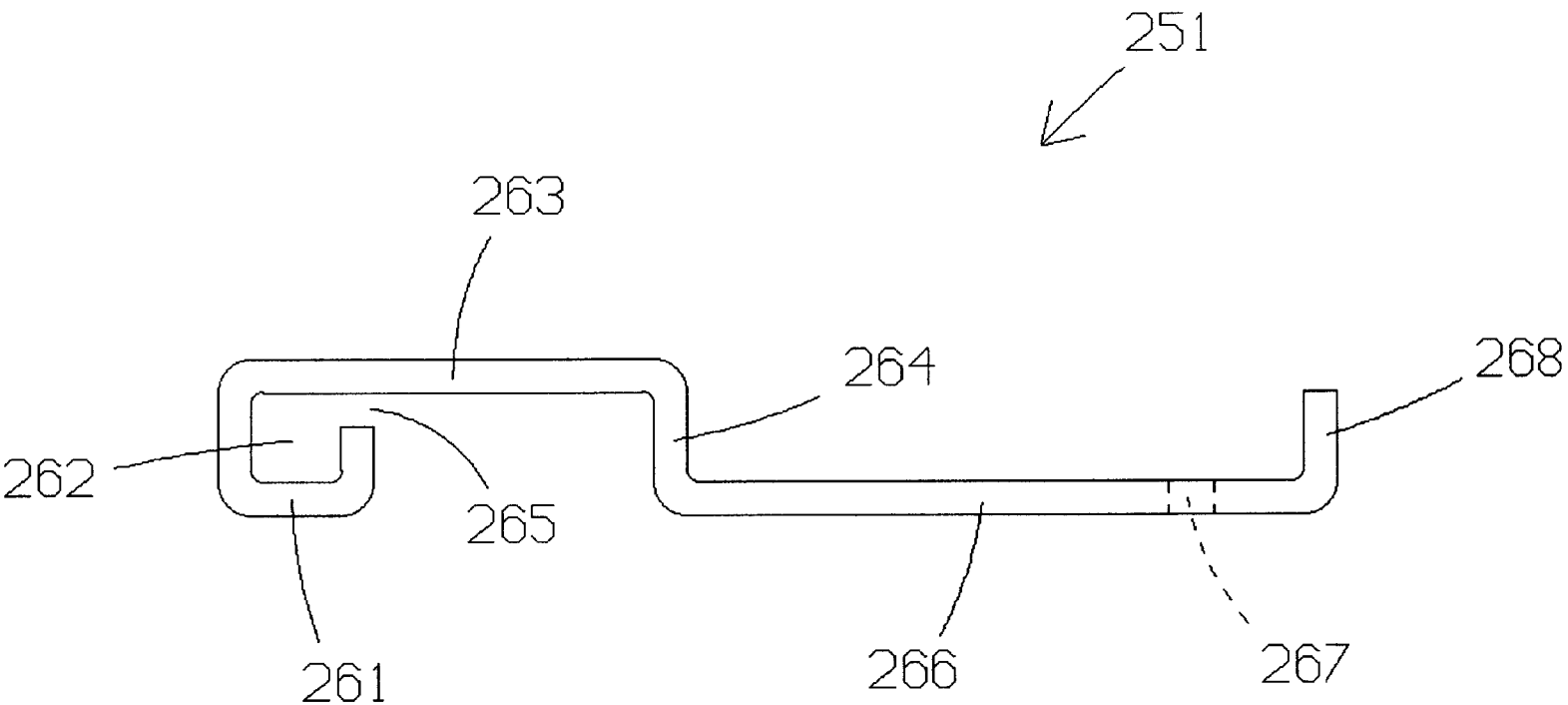
FIG. 2 is a top view of a supplemental weight on the exercise apparatus of FIG. 1.

Secondary weights 251 and 252 are movably mounted on the guide rods 112*b* and 114*b* above the top plate 123*b*. As shown in FIG. 2 (where the depicted weight 251 is a mirror image of the other weight 252), the weight 251 is a bar that has been bent or otherwise formed to interact with the guide rods 112*b* and 114*b* while avoiding the selector rod 130*b* and/or the cable 138*b*.

A first end 261 of the bar 251 forms a substantially closed loop that is interrupted by a slot 265 disposed between the end 261 and an intermediate segment 263. The loop bounds an opening 262 sufficient in size to accommodate the guide rod 112*b*. A central segment 264 of the bar 251 is interconnected transversely between the intermediate segment 263 and an opposite intermediate segment 266. The segments 263 and 266 are different lengths to space the segment 264 apart from the selector rod 130*b* and cable 138*b*. A notch 267 is formed in the underside of the segment 266, near the second, opposite end 268, for reasons explained below.

When the weight 251 is arranged as shown in FIG. 1, the first end 261 rests upon a transversely extending pin 215 rigidly secured to the guide rod 112*b*, and the segment 266 rests upon a transversely extending hook 217 rigidly secured to the guide rod 114*b*. The first end 261 of the weight 252 rests upon a similar, but relatively higher pin 215 on the guide rod 114*b*, and the segment 266 on the weight 252 rests upon a similar, but relatively higher hook 217 on the guide rod 112*b*. In other words, the machine frame supports the weights 251 and 252 at separate, vertically aligned positions with a gap defined therebetween.

Each hook 217 has a radially extending shaft which nests inside a respective notch 267, and an upwardly extending end which discourages rotation of a respective weight 251 or 252 about a respective guide rod 112*b* or 114*b*. The weight 251 is lowered into an active position by lifting the weight 251 off the hook 217 and rotating the weight 251 until the slot 265 aligns with the pin 215. The gap between the inactive weights 251 and 252 is sufficient to accommodate movement of the weight 251 independent of the weight 252. Once the weight 251 has been lowered onto the top plate 123*b*, the weight 252 may be lowered in similar fashion.

Figure 3:
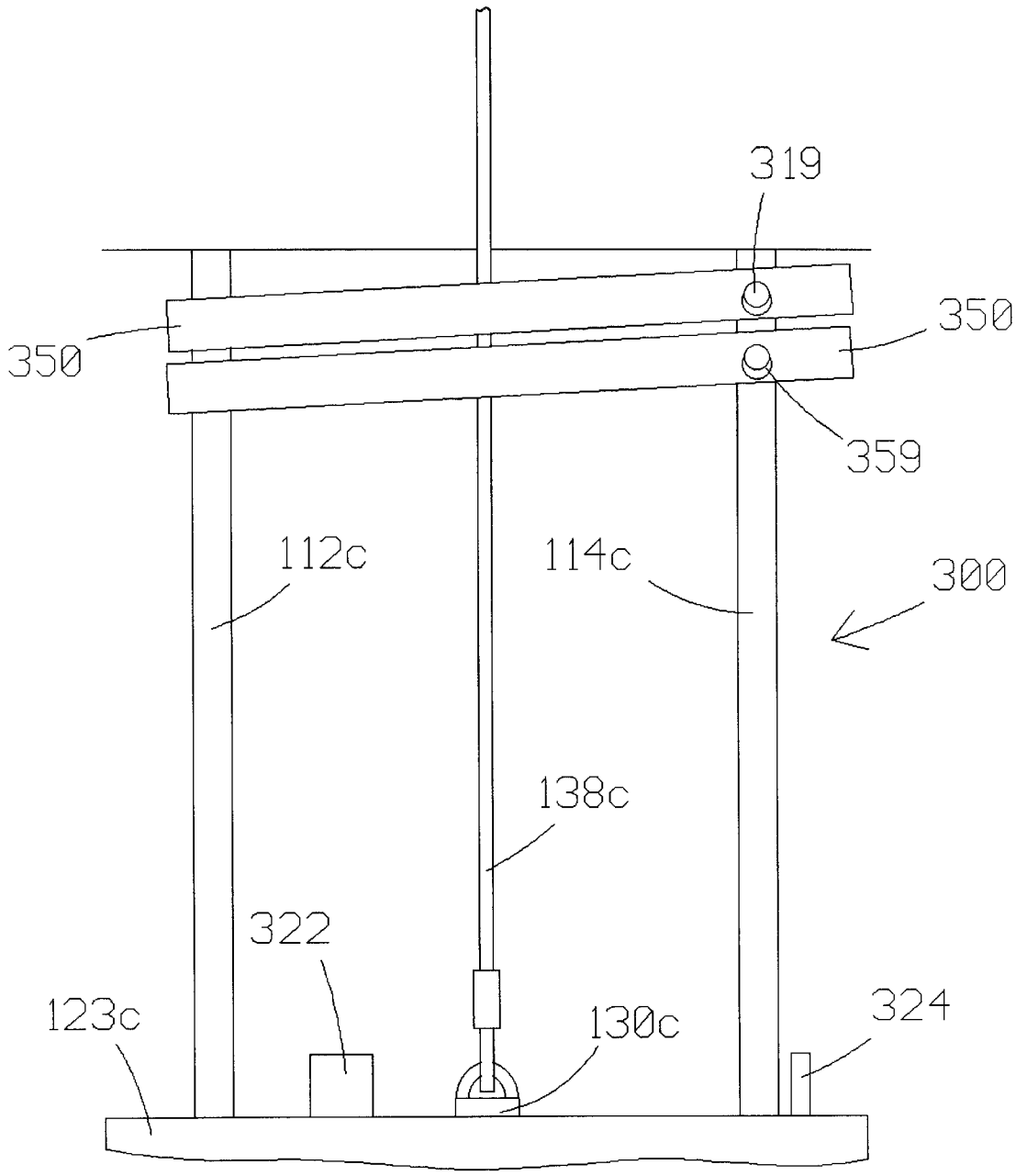
FIG. 3 is a partially fragmented, front view of another exercise apparatus constructed according to the principles of the present invention.

FIG. 3 shows another weight stack exercise machine 300 which has been assembled in accordance with the principles of the present invention. The machine 300 similarly includes a weight stack, including top plate 123*c* and underlying weight plates, movably mounted on guide rods 112*c* and 114*c*. A selector rod 130*c* extends through the weight stack and is connected to a force receiving member by means of cable 138*c*.

Figure 4:
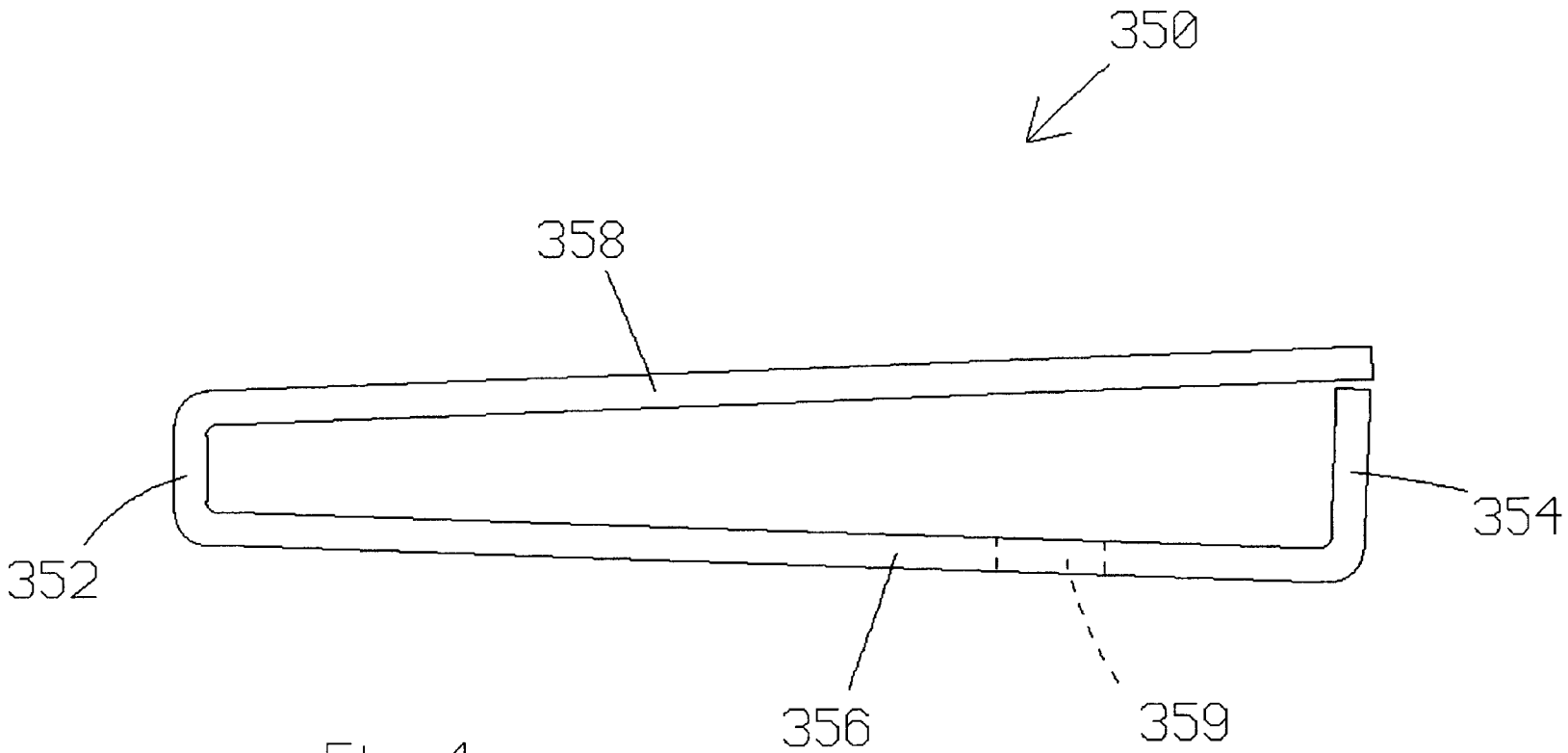
FIG. 4 is a top view of a supplemental weight on the exercise apparatus of FIG. 3.

Secondary weights 350 are movably mounted on the guide rods 112*c* and 114*c* above the top plate 123*c*. As shown in FIG. 4, each weight 350 is a bar that has been bent or otherwise formed to interact with the guide rods 112*c* and 114*c* and not interfere with the selector rod 130*c* and/or the cable 138*c*. More specifically, each bar 350 may be described as a substantially closed loop having relatively short ends 352 and 354 and relatively long sides 356 and 358. Each loop is sized and configured to fit around both guide rods 112*c* and 114*c*. A hole 359 is formed in the front side 356 of the bar 350, proximate the relatively longer end 354, for reasons explained below.

When either weight 350 is arranged as shown in FIG. 3, the second end 354 is supported by a respective, transversely extending bolt 319 rigidly secured to the guide rod 114*c*, and the first end 352 rests against the guide rod 112*c*. As a result of this arrangement, the upper weight 350 is supported in a vertically aligned, spaced apart position relative to the lower weight 350. Each bolt 319 has a shaft which extends through a respective hole 359, and a larger diameter head which discourages rotation of a respective weight 350 about the guide rod 112*c*. The lower weight 350 is lowered onto the top plate 123*c* by lifting the weight 350 off the bolt 319 and rotating the weight 350 until the front side 356 clears the head of the bolt 319. The upper weight 350 may then be lowered into an active position in similar fashion.

Supports 322 and 324 are provided on the top plate 123*c* to stabilize the weights 350 during exercise. The support 322 has a trapezoidal shape which engages the sides 356 and 358 to discourage movement of the end 352 toward the guide rod 114*c*, and the support 324 has a rectangular shape which engages the end 354 to discourage movement of the end 354 toward the guide rod 112*c*. An advantage of this embodiment 300 (and other embodiments described herein) is that the mass of each of the weights 350 is relatively evenly distributed across the top plate 123*c* and/or centered relative to the selector rod 130*c*.

Figure 5:
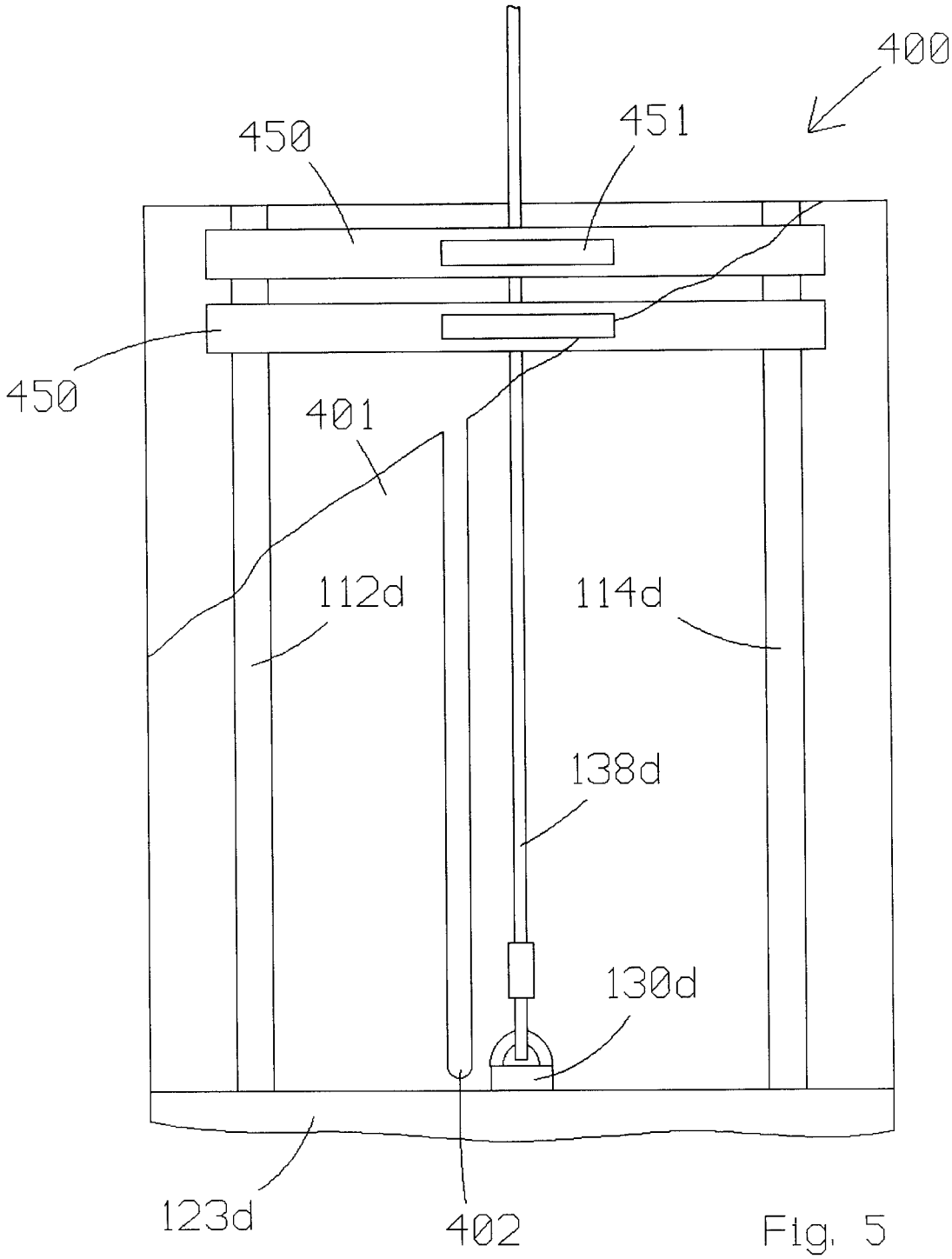
FIG. 5 is a partially fragmented, front view of another exercise apparatus constructed according to the principles of the present invention.

FIG. 5 shows another weight stack exercise machine 400 which has been assembled in accordance with the principles of the present invention. The machine 400 similarly includes a weight stack, including top plate 123*d* and underlying weight plates, movably mounted on guide rods 112*d* and 114*d*. A selector rod 130*d* extends through the weight stack and is connected to a force receiving member by means of cable 138*d*.

Figure 6:
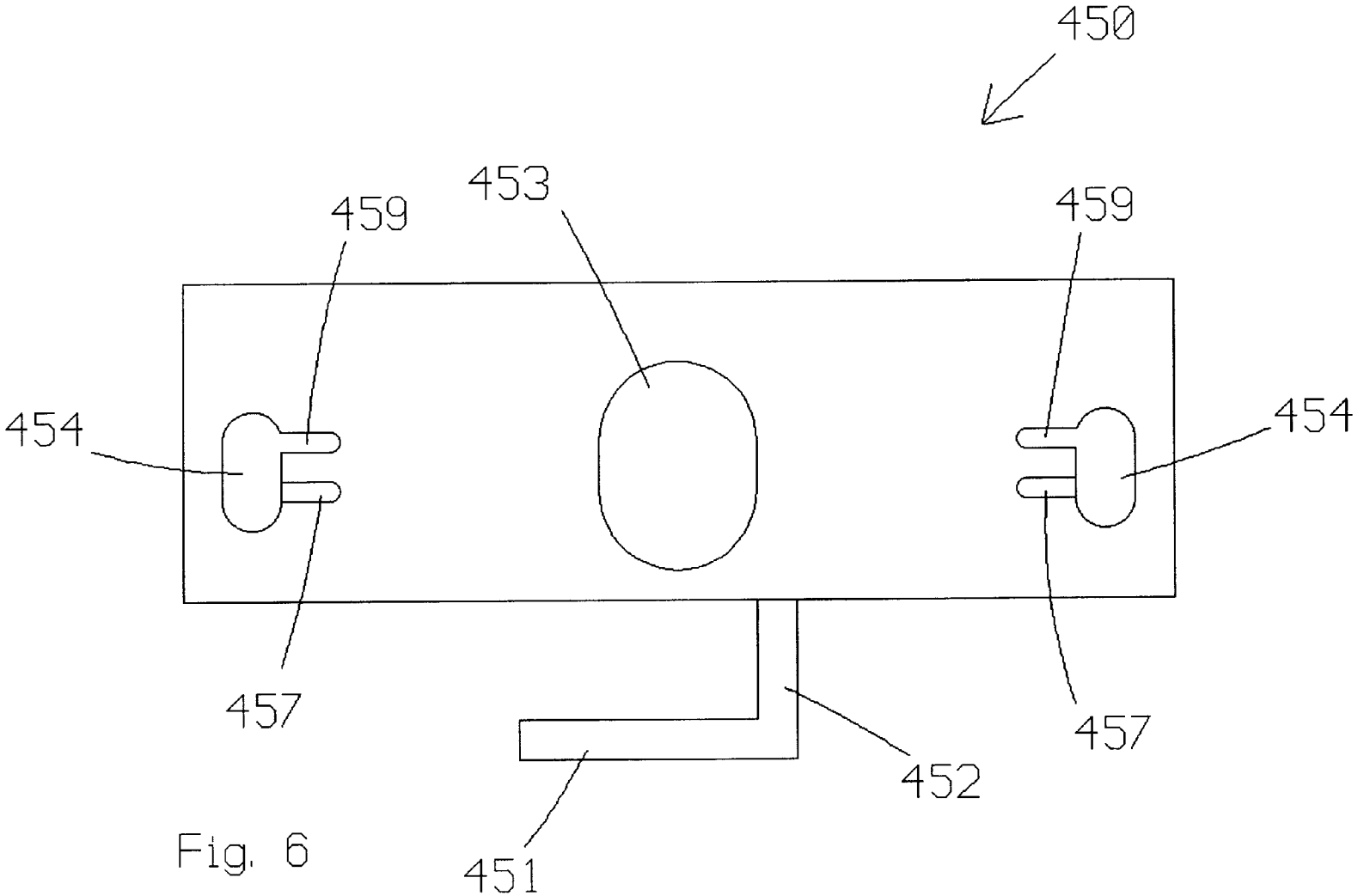
FIG. 6 is a bottom view of a supplemental weight on the exercise apparatus of FIG. 5.

Secondary weights 450 are movably mounted on the guide rods 112*d* and 114*d* above the top plate 123*d*. Also, a safety shield 401 is provided to substantially cover or enclose the moving parts of the apparatus 400. A slot 402 is provided in the shield 401 to facilitate manipulation of the supplemental weights 450. As shown in FIG. 6, a shaft 452 is sized and configured to extend through the slot 402 and connect a respective weight 450 to a respective handle 451 disposed on the near side of the shield 401.

A central hole 453 is formed through each weight 450 to provide clearance for the cable 138*d*. Smaller oval holes 454 are formed through each weight 450 to accommodate the guide rods 112*d* and 114*d*. Vertically spaced pairs of weight engaging pins (not shown) extend transversely from respective guide rods 112*d* and 114*d* and toward one another. Transverse notches 457 are formed in the bottom of each weight 450 to engage the pins when the weight 450 occupies a first position relative to the guide rods 112*d* and 114*d*. Transverse slots 459 are formed through each weight 450 to accommodate passage of the pins when the weight 450 occupies a second, transversely displaced position relative to the guide rods 112*d* and 114*d*.

Each weight 450 is lowered onto the top plate 123*d* by pulling the handle 451 toward the reader and allowing the weight 450 to descend. The shield 401 may be made to cooperate with the shaft 452 in a manner which controls descent of the weight 450 but does not interfere with ascent of the weight 450. Also, the weights 450 (as well as the weights on other embodiments) may be coated with a shock absorbing material or otherwise modified to reduce impact and/or noise during operation.

Figure 7:
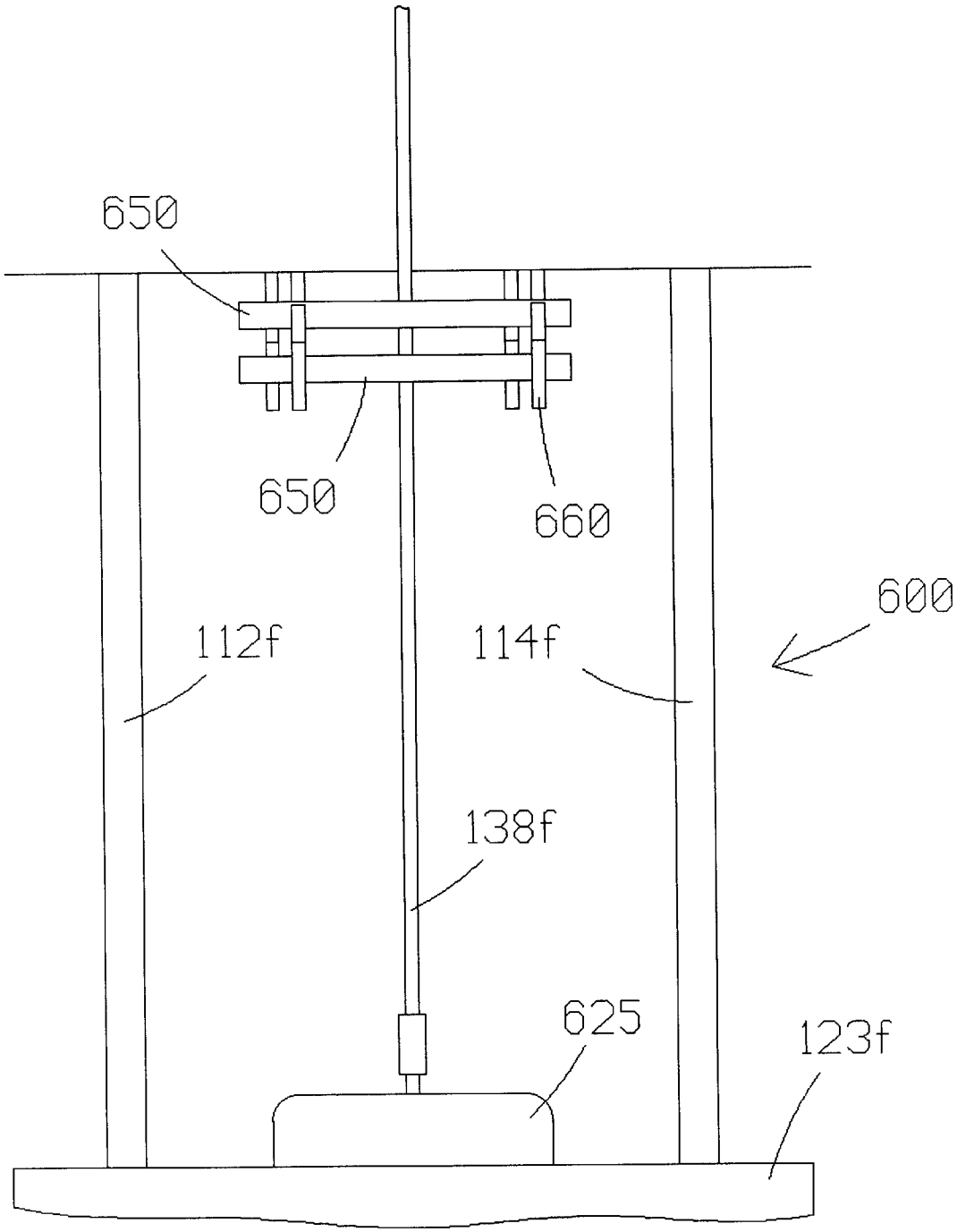
FIG. 7 is a partially fragmented, front view of another exercise apparatus constructed according to the principles of the present invention.

FIG. 7 shows another weight stack exercise machine 600 which has been assembled in accordance with the principles of the present invention. The machine 600 similarly includes a weight stack, including top plate 123*f* and underlying weight plates, movably mounted on guide rods 112*f* and 114*f*. A selector rod extends through the weight stack and is connected to a force receiving member by means of cable 138*f*.

Secondary weights 650 are selectively movable onto the top plate 123*f* along a path dictated by cable 138*f*. Each weight 650 forms a substantially closed loop about the cable 138*f*, while the guide rods 112*f* and 114*f* are disposed outside the loop. When lowered onto the top plate 123*f*, each weight 550 fits snugly about a block 625 on the top plate 123*f*. As suggested elsewhere in this description, the block 625 is only one of several positioning devices suitable for use on this embodiment 600 and/or the other embodiments disclosed herein.

Figure 8:
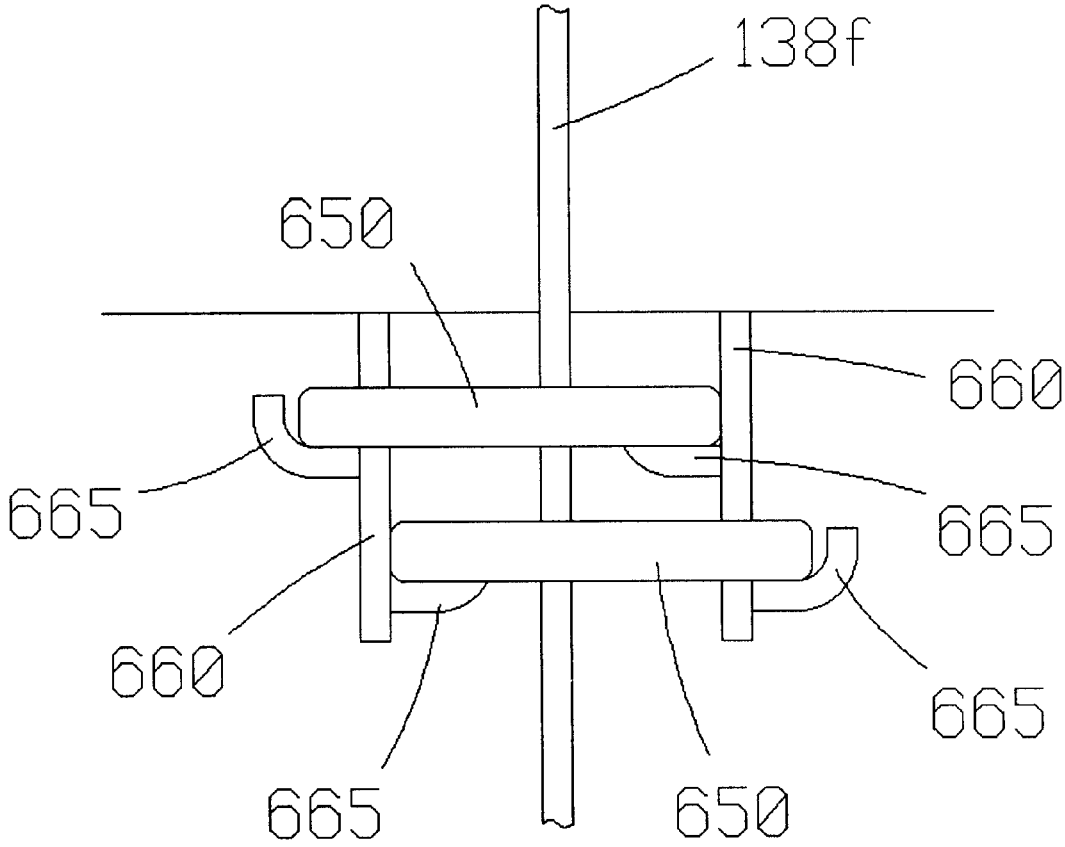
FIG. 8 is a side view of supports and supplemental weights on the exercise apparatus of FIG. 7.

Supports 660 are secured to the frame of the apparatus 600 and extend downward toward the top plate 123*f*. As shown in FIG. 8, the supports 660 provide hooks 665 to selectively retain the weights 650 at respective locations, one above the other with a gap disposed therebetween. The lower weight 650 is lowered onto the top plate 123*f* by first moving it upward and away from the reader and then moving it downward when free of the hooks 665. An advantage of this embodiment (and certain other embodiments described herein) is that the weights 650 do not engage the guide rods 112*f* and 114*f*, but are still connected to the apparatus 600.

Figure 9:
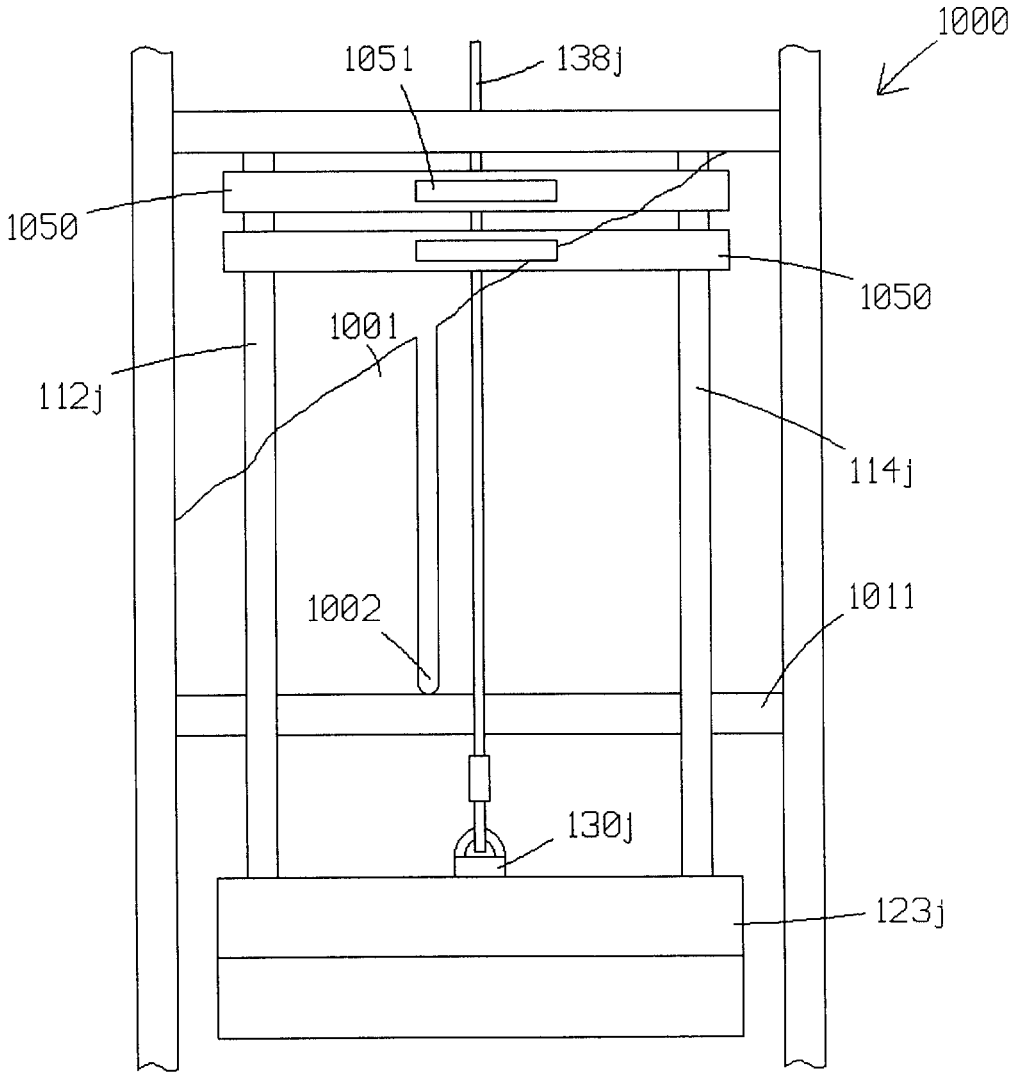
FIG. 9 is a partially fragmented, front view of another exercise apparatus constructed according to the principles of the present invention.

FIG. 9 shows another weight stack machine 1000 which has been assembled in accordance with the principles of the present invention, and which is similar in many respects to the machine 400 shown in FIG. 5. The machine 100 similarly includes a weight stack, including top plate 123*j* and underlying weight plates, movably mounted on guide rods 112*j* and 114*j*. A selector rod 130*j* extends through the weight stack and is connected to a force receiving member by means of cable 138*j*.

Figure 10:
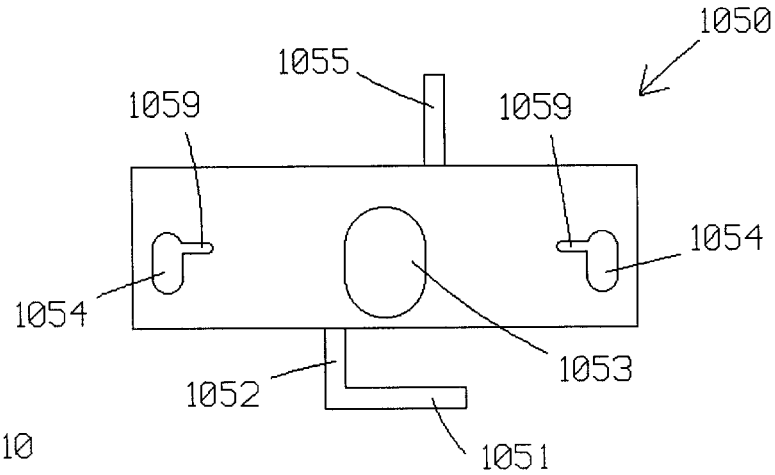
FIG. 10 is a top view of a supplemental weight on the exercise apparatus of FIG. 9.
Figure 11:
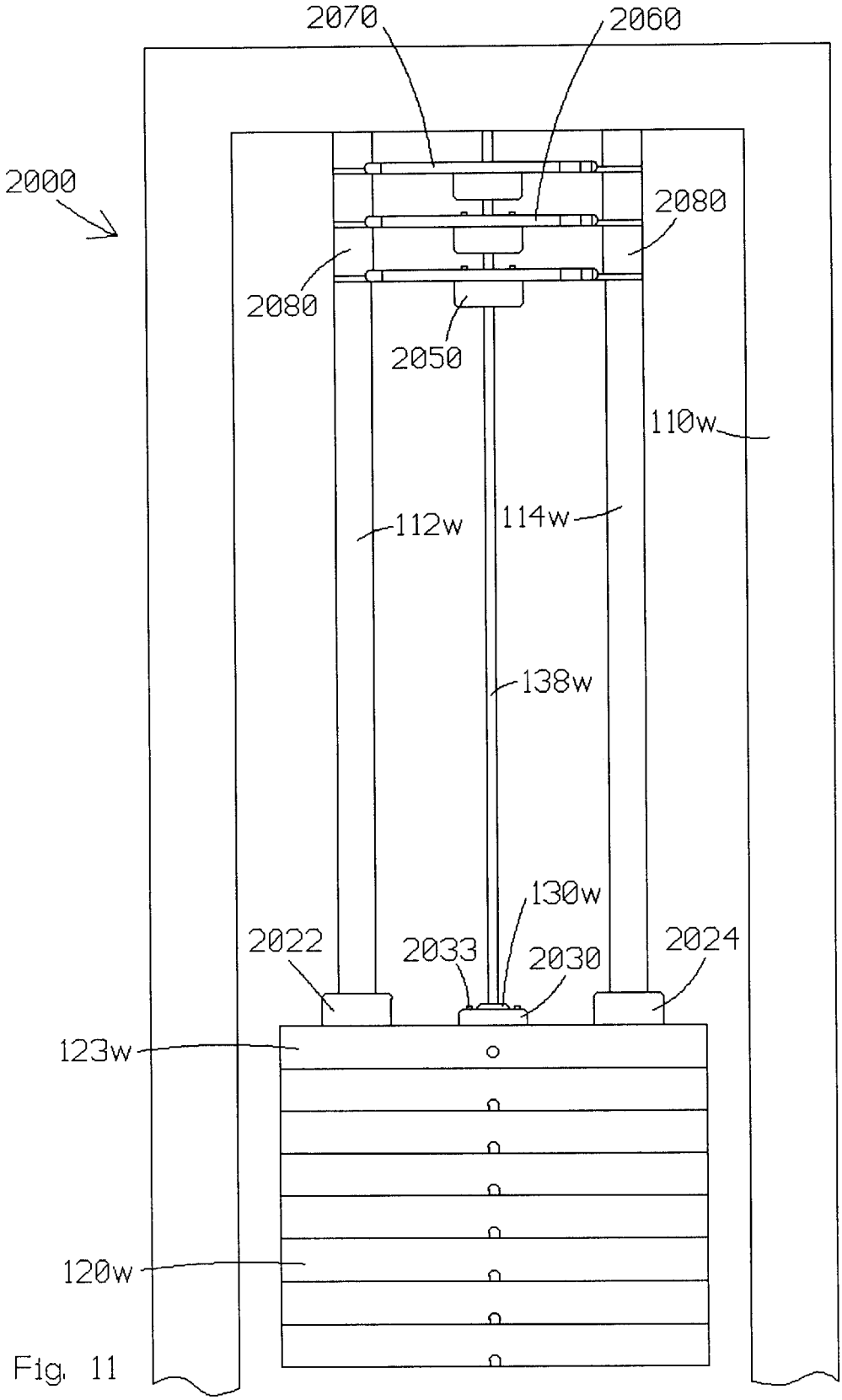
FIG. 11 is a partially fragmented, front view of another exercise apparatus constructed according to the principles of the present invention.

Secondary weights 1050 are movably mounted on the guide rods 112*j* and 114*j* above the top plate 123*j*. Also, a safety shield 1001 is provided to substantially cover or enclose the moving parts of the apparatus 1000. A slot 1002 is provided in the shield 1001 to facilitate manipulation of the supplemental weights 1050. As shown in FIG. 10, a shaft 1052 is sized and configured to extend through the slot 1002 and connect a respective weight 1050 to a respective handle 1051 disposed on the near side of the shield 1001.

A central hole 1053 is formed through each weight 1050 to provide clearance for the cable 138*j*. Smaller oval holes 1054 are formed through each weight 1050 to accommodate the guide rods 112*j* and 114*j*. Vertically spaced pairs of pins (not shown) extend transversely from respective guide rods 112*j* and 114*j* and toward one another. Transverse notches (not shown) are formed in the bottom of the weight 1050 to engage the pins when the weight 1050 occupies a first position relative to the guide rods 112*j* and 114*j*. Transverse slots 1059 are formed through the weight 1050 to accommodate passage of the pins when the weight 1050 occupies a second, displaced position relative to the guide rods 112*j* and 114*j*.

Each weight 1050 is lowered toward the top plate 123*j* by pulling the handle 1051 toward the reader and allowing the weight 1050 to descend. The slot 1002 does not extend all the way down to the lowermost position of the top plate 123*j*. Also, a frame member 1011 spans the rear of the machine 1000 and cooperates with a rearwardly extending pin 1055 on each weight 1050 to further limit downward movement of each weight 1050. As a result, each weight 1050 is movable into the path of the top plate 123*j* but is supported by the top plate 123*j* only after the latter has traveled upward a first distance. After the top plate 123*j* reaches the lower extent of the slot 1002, continued upward movement of the top plate 123*j* encounters additional resistance to the extent that any supplemental weights 1050 are within the path of the top plate 123*j*.

Like on the previously described machine 400, the shield 1001 may be made to cooperate with the shaft 1052 in a manner which controls descent of the weight 1050 but does not interfere with ascent of the weight 1050. Also, the weights 1050 (as well as the weights on other embodiments) may be coated with a shock absorbing material or otherwise modified to reduce impact and/or noise during operation.

FIGS. 11 and 17–20 show another weight stack exercise machine 2000 which has been assembled in accordance with the principles of the present invention. The machine 2000 includes a frame 110*w* designed to rest upon a floor surface. First and second guide rods 112*w* and 114*w* extend vertically between lower and upper ends of the frame 110*w*. A top plate 123*w* and underlying weight plates 120*w* are arranged in a vertical stack and movably mounted on the guide rods 112*w* and 114*w* by suitable means known in the art. On the machine 2000, bushings 2022 and 2024 are movably mounted on frame 110*w* and 114*w* and rigidly secured to the top plate 123*w*. When not in use, the plates 123*w* and 120*w* rest on a shock absorbing member (not shown) on the lower end of the frame 110*w*.

A selector rod 130*w* is connected to the top plate 123*w* and extends through the underlying plates 120*w*. The selector rod 130*w* may be selectively connected to any desired weight plate 120*w* by a selector pin (or other suitable means known in the art). A cable 138*w* extends from an upper end of the selector rod 130*w* to one or more force receiving members which operate in a manner known in the art. As a result, movement of a force receiving member is resisted by gravity acting on the mass of the selected weight plates.

Opposing weight holders 2080 are rigidly mounted on respective guide rods 112*w* and 114*w* to support supplemental or secondary weights 2050, 2060, and 2070, each of which preferably weighs one-fourth as much as one of the weight plates 120*w*. The middle weight 2060, shown by itself in FIGS. 12–13, is identical to the lower weight 2050, and with the exception of registration pegs 2063, is also like the upper weight 2070. The weight 2060 includes a central block or hub portion 2061 and an upper plate portion 2062 which are concentrically aligned and rigidly secured to one another. The plate portion 2062 has a diameter which is only slightly less than the distance between the opposing weight holders 2080 (leaving a one-eighth inch gap on each side, for example).

The registration pegs 2063 on the middle weight 2060 project upward from the plate portion 2062, opposite the hub portion 2061, and align with similarly sized and configured holes in the bottom of the overlying hub portion 2061 on the upper weight 2070. Similar pegs 2033 project upward from a block 2030 on the top plate 123*w* and align with similarly sized and configured holes in the bottom of the hub portion 2061 on the lower weight 2050. The pegs 2033 or 2063 register the secondary weights 2050, 2060, and 2070 relative to each other and/or the top plate 123*w* (depending upon operational circumstances described below).

A central hole 2064 extends through each plate portion 2062 and hub portion 2061 to accommodate the connector 138*w*, which has a significantly smaller diameter. Although the weight 2060 is shown to be a unitary member, those skilled in the art will recognize that it could be provided in complementary pieces. For example, the hub portion 2061 and the plate portion 2062 could be separate pieces which are connected by screws extending through the plate portion 2062 and into the hub portion 2061, and non-aligned slots could extend from the hole 2064 to the edge of each piece 2061 and 2062 to facilitate mounting of the individual pieces about an intermediate portion of the connector 138*w* (without access to either end). On this alternative embodiment, the heads of the screws could be configured to function as the registration pegs.

Depressions or recesses 2067 extend into the bottom side of the plate portion 2062 at diametrically opposed locations. Also, notches or openings 2068 extend through the plate portion 2062 at diametrically opposed locations which are offset thirty degrees from the recesses 2067. Both the openings 2068 and the recesses 2067 are sized and configured to accommodate opposing tabs 2085, 2086, and 2087 on the weight holders 2080. The openings 2068 are somewhat wider than the recesses 2067 to facilitate unencumbered passage of the tabs 2085, 2086, and/or 2087 through the openings 2068. First and second stops 2065 and 2066 project radially outward from the plate portion 2062.

A weight holder 2080 is shown by itself in FIGS. 14–16. The weight holder 2080 has a sidewall 2081 which defines a U-shaped channel 2082 and is sized and configured to fit snugly, like a sleeve, onto a respective guide rod 112*w* or 114*w*. Holes 2083 extend transversely through opposite sides of the sidewall 2081 to facilitate mounting of the weight holder 2080 to either guide rod 112*w* or 114*w*. The tabs 2085, 2086, and 2087 project outward from the sidewall 2081, opposite the channel 2082, and at spaced locations along the sidewall 2081. Reinforcing ribs 2084 are integrally joined to opposite sides of respective tabs 2085, 2086, and 2087, and extend about opposite sides of the sidewall 2081.

Figure 17:
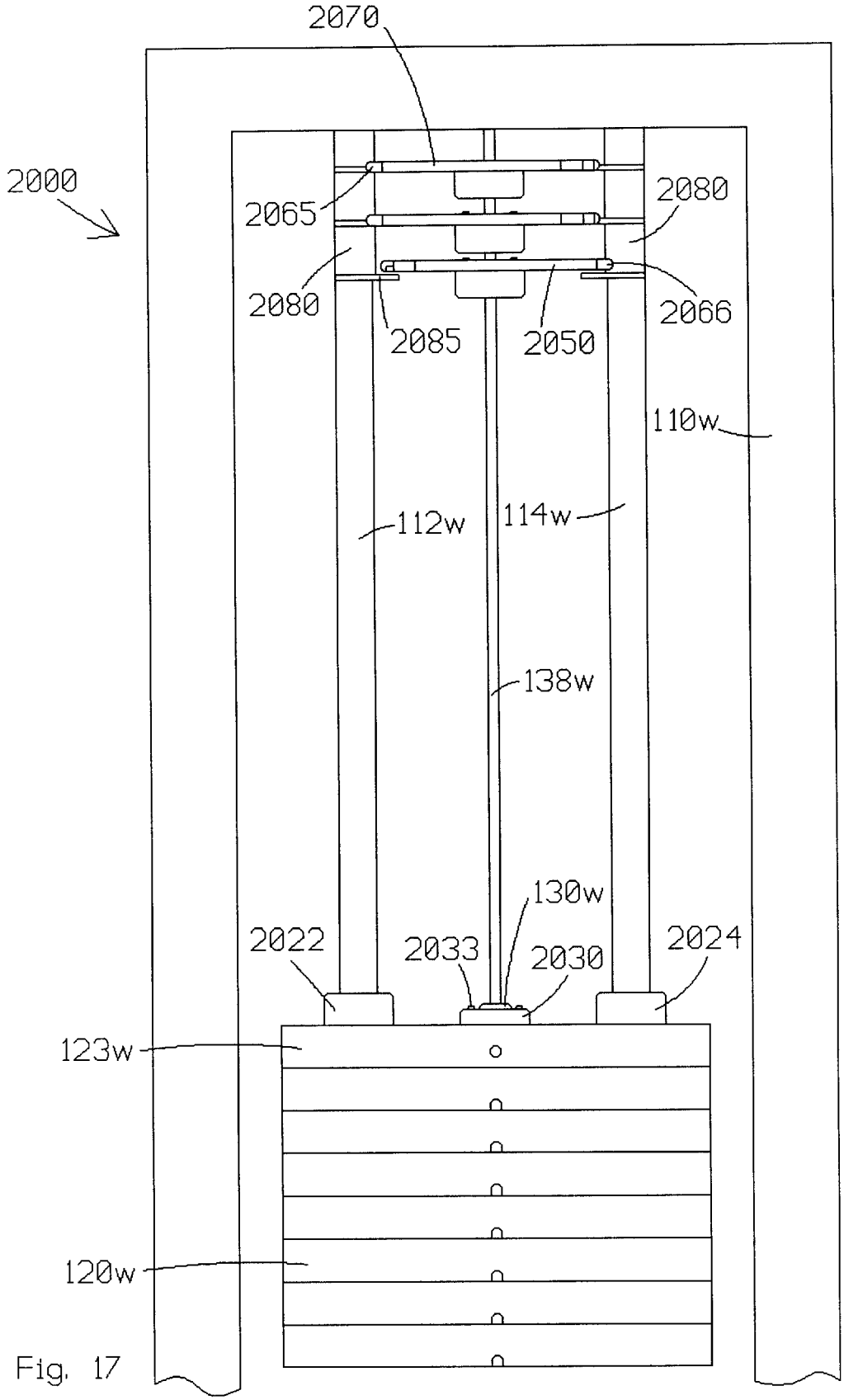
FIG. 17 is a partially fragmented, front view of the exercise apparatus of FIG. 11, with the lowermost secondary weight moved out of engagement with the secondary weight holder.

Each of the stops 2065 and 2066 on the plate portion 2062 defines a common radius which is greater than one-half the distance between the opposing weight holders 2080 (projecting one-half inch beyond the circumference of the plate portion 2062, for example). An angle of approximately one hundred and twenty degrees is defined between the two stops 2065 and 2066. As shown in FIG. 17, the stop 2065 is adjacent the left side weight holder 2080 when a respective secondary weight (weight 2070, for example) occupies a storage position relative to the weight holders 2080 (with the tabs 2087 disposed in the recesses 2067 in the weight 2070). When a secondary weight (weight 2050, for example) is rotated thirty degrees from its storage position to a released position, the respective stop 2066 is adjacent the right side weight holder 2080 (and the tabs 2085 align with the openings 2068 in the weight 2050). In this released position, the weight 2050 is free to move downward onto the top plate 123*w*.

Figure 18:
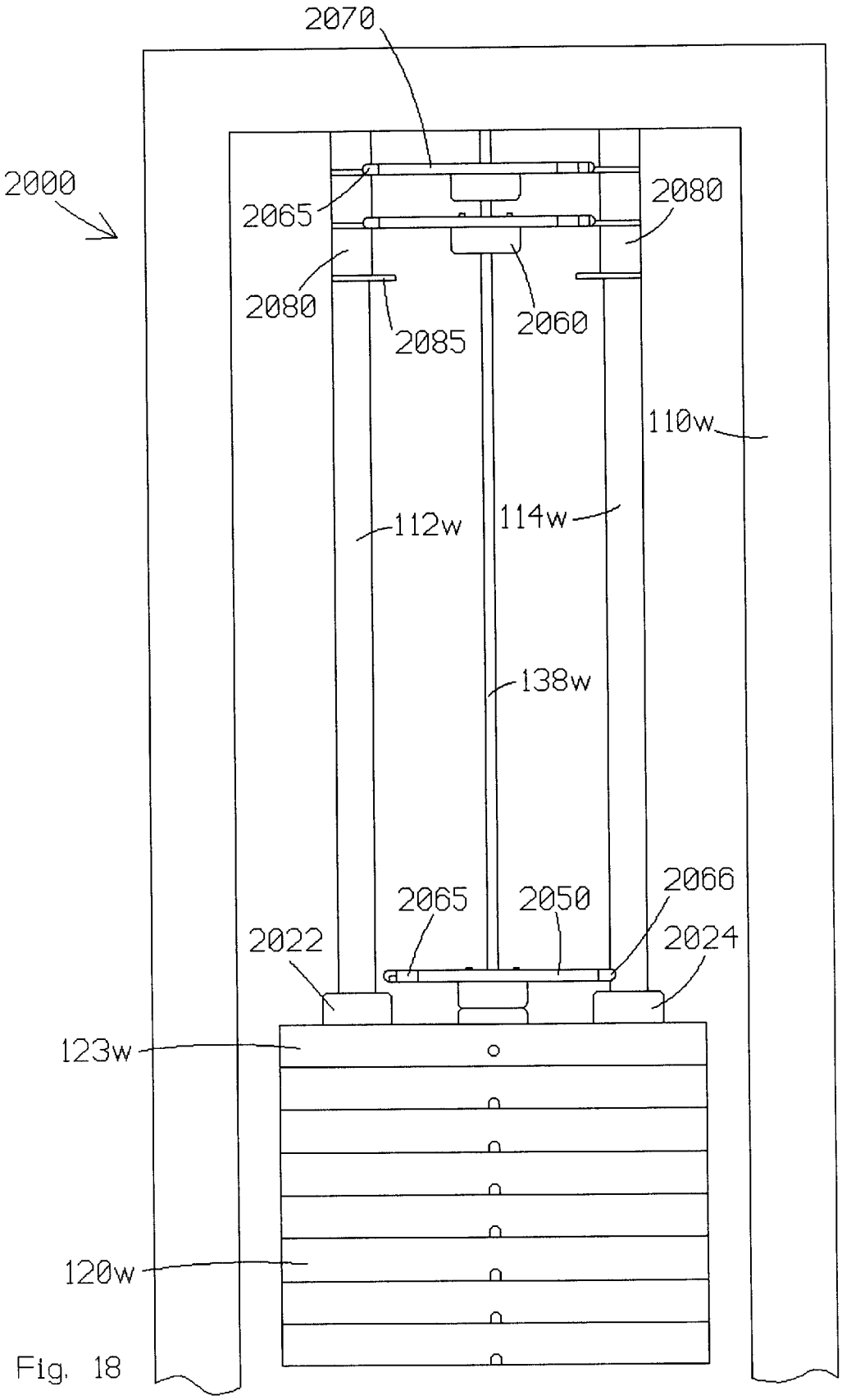
FIG. 18 is a partially fragmented, front view of the exercise apparatus of FIG. 11, with the lowermost secondary weight moved onto the top plate of the weight stack.

FIG. 17 shows the lower weight 2050 rotated to a released position, while the other weights 2060 and 2070 remain in their respective storage positions. FIG. 17 also demonstrates that the lower weight 2050 may be maneuvered between an active position and an inactive position without contacting or otherwise disturbing the overlying weights 2060 and/or 2070. FIG. 18 shows the lower weight 2050 lowered onto the top plate 123*w*, while the other weights 2060 and 2070 remain in their respective storage positions. The block 2030 on the top plate 123*w* maintains the plate portion 2062 above the bushings 2022 and 2024, and the registration pegs 2033 keep the plate portion 2062 out of contact with the guide rods 112*w* and 114*w*.

Figure 19:
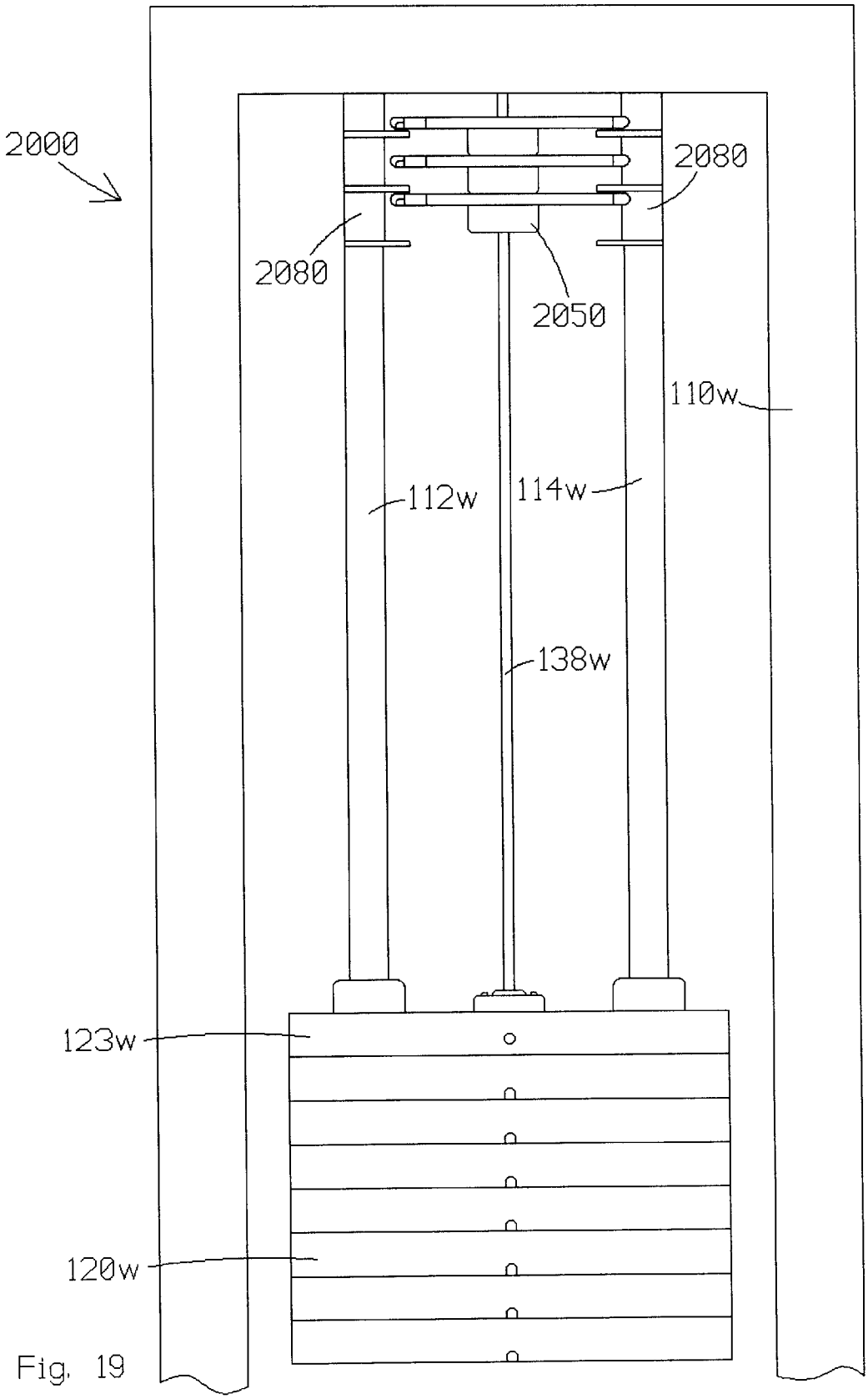
FIG. 19 is a partially fragmented, front view of the exercise apparatus of FIG. 11, with all three secondary weights moved out of engagement with the secondary weight holder.
Figure 20:
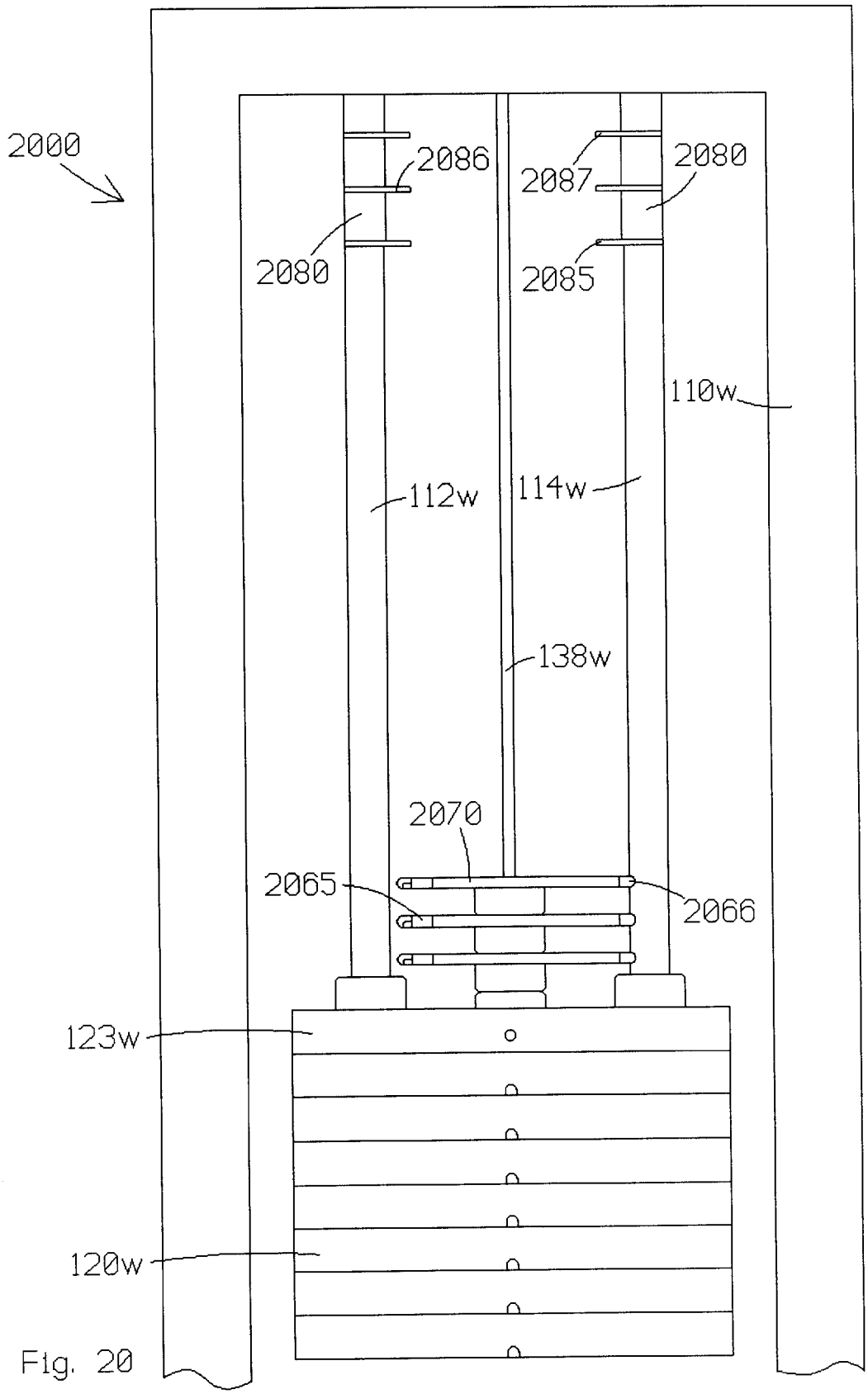
FIG. 20 is a partially fragmented, front view of the exercise apparatus of FIG. 11, with all three secondary weights moved onto the top plate in the weight stack.

FIG. 19 shows all three secondary weights 2050, 2060, and 2070 rotated to their released positions, with the middle weight 2060 resting on the lower weight 2050, and the upper weight 2070 resting on the middle weight 2060. This situation is reached by first pushing the lower weight 2050 upward until it contacts the middle weight 2060 and the middle weight 2060 contacts the upper weight 2070, and then rotating all three weights 2050, 2060, and 2070 together relative to the frame 110*w*. FIG. 20 shows all three secondary weights 2050, 2060, and 2070 lowered onto the top plate 123*w* . The registration pegs 2063 constrain the weights 2050, 2060, and 2070 to rotate together when situated as shown in FIG. 19, and to remain out of contact with the guide rods 112*w* and 114*w* when situated as shown in FIG. 20.

The foregoing description not only discloses specific embodiments and methods, but it will also lead those skilled in the art to recognize additional embodiments, methods, improvements, combinations, and/or applications. Among other things, one or more features of a particular embodiment may be suitable for use on another embodiment, either alone or in combination with features from still other embodiments. Also, on some of the embodiments, the supplemental weights may be movably connected to dedicated, flexible guide members (interconnected between the top plate and an upper portion of the frame) either in addition to or rather than the connector cable and/or the weight stack guide rods. In view of the foregoing, the scope of the present invention is to be limited only to the extent of the following claims.

What is claimed is:

1. An exercise apparatus, comprising:

a frame;

a stack of primary weights movably mounted to the frame, wherein the stack of weights includes a top plate which is movable along a path;

a plurality of secondary weights, including a first weight and a second weight selectively movable between respective active positions, acting upon the top plate, and respective inactive positions, supported by the frame outside the path of the top plate, with the second weight disposed over and separated from the first plate, wherein the respective active positions vertically overlap the respective inactive positions; and means for constraining each said secondary weight to move along a predetermined path relative to the frame between the active and inactive positions.

2. The exercise apparatus of claim 1, wherein the first weight and the second weight have respective portions that register with one another when the weights occupy their respective active positions.

3. The exercise apparatus of claim 1, wherein the frame supports the first weight when the first weight occupies a first orientation relative to the frame, and the first weight is free to move downward relative to the frame when the first weight occupies a second orientation relative to the frame.

4. The exercise apparatus of claim 3, wherein the frame supports the second weight when the second weight occupies a first orientation relative to the frame, and the second weight is free to move downward relative to the frame when the second weight occupies a second orientation relative to the frame.

5. The exercise apparatus of claim 4, wherein the first weight and the second weight define a gap therebetween when in their respective inactive positions, and the gap is sufficiently large to accommodate both upward movement and rotation of the first weight independent of the second weight.

6. The exercise apparatus of claim 5, wherein the first weight and the second weight are configured to register with one another when the first weight is moved from its inactive position upward into contact with the second weight, thereby constraining the second weight to rotate together with the first weight relative to the frame.

7. The exercise apparatus of claim 1, wherein the first weight and the top plate are configured to register with one another when the first weight occupies its active position.

8. The exercise apparatus of claim 1, further comprising a flexible connector interconnected between the top plate and a force receiving member.

9. The exercise apparatus of claim 8, wherein the connector extends through the first weight and the second weight.

10. The exercise apparatus of claim 1, wherein the frame includes at least one guide rod that extends through the stack of primary weights and each of said secondary weights.

11. A method of adjusting resistance to exercise, comprising the steps of:

providing a frame;

providing a stack of weights which includes a top plate;

movably mounting the stack on the frame in such a manner that the top plate is movable along a path;

providing a first secondary weight and a second secondary weight;

providing a first support on the frame to support to support the first secondary weight at a first rest position outside the path of the top plate;

providing a second support on the frame to support to support the second secondary weight at a second rest position outside the path of the top plate, above the first secondary weight, and with a gap of separation defined therebetween;

moving the first secondary weight from the first rest position to an active position acting upon the top plate without moving the second secondary weight;

moving the second secondary weight from the second rest position to an active position acting upon the top plate; and constraining each said secondary weight to move along a predetermined path relative to the frame between their respective rest positions and their respective active positions.

12. The method of claim 11, wherein the first secondary weight and the second secondary weight are provided with respective portions that register with one another when the first secondary weight and the second secondary weight are maneuvered into contact with one another.

13. The method of claim 11, wherein the the first secondary weight and the top plate are provided with respective portions that register with one another when the first secondary weight is lowered onto the top plate.

14. The method of claim 11, wherein the first secondary weight is configured to rotate into and out of engagement with the first support.

15. The method of claim 11, further comprising the steps of interconnecting a connector between the top plate and a force receiving member, and routing the connector through each said secondary weight.

16. The method of claim 11, further comprising the step of selectively maneuvering at least one said secondary weight into an active position, acting upon the top plate.

17. A method of adjusting resistance to exercise, comprising the steps of:

providing a frame;

providing a stack of weights which includes a top plate;

movably mounting the stack on the frame in such a manner that the top plate is movable along a path;

providing a first secondary weight and a second secondary weight;

providing a first support on the frame to support to support the first secondary weight at a first rest position outside the path of the top plate;

providing a second support on the frame to support to support the second secondary weight at a second rest position outside the path of the top plate, above the first secondary weight, and with a gap of separation defined therebetween;

moving the first secondary weight from the first rest position to an active position acting upon the top plate without moving the second secondary weight;

moving the second secondary weight from the second rest position to an active position acting upon the top plate; and constraining each said secondary weight to move along a predetermined path relative to the frame between their respective rest positions and their respective active positions such that the second secondary weight remains above the first secondary weight at all times.

18. The method of claim 17, further comprising the step of selectively maneuvering the first secondary weight out of the first position and into an active position, acting upon the top plate.

19. The method of claim 18, further comprising the step of selectively maneuvering the second secondary weight out of the second position and into an active position, acting upon the top plate.

20. The method of claim 19, wherein the maneuvering step of claim 19 is performed during the maneuvering step of claim 18 by initially moving the first secondary weight upward into contact with the second secondary weight.

* * * * *